US006890204B2

(12) United States Patent
Yamawaki

(10) Patent No.: US 6,890,204 B2
(45) Date of Patent: May 10, 2005

(54) LOCKING MECHANISM FOR CONNECTOR

(75) Inventor: Takanori Yamawaki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 163 days.

(21) Appl. No.: 10/208,208

(22) Filed: Jul. 31, 2002

(65) Prior Publication Data

US 2003/0045153 A1 Mar. 6, 2003

(30) Foreign Application Priority Data

Jul. 31, 2001 (JP) ..... 2001-232005

(51) Int. Cl.[7] ..... H01R 13/627
(52) U.S. Cl. ..... 439/350; 439/354
(58) Field of Search ..... 439/350–357

(56) References Cited

U.S. PATENT DOCUMENTS 5,219,300 A 6/1993 Yagi et al.
5,254,014 A 10/1993 Yagi et al.
5,380,217 A 1/1995 Yagi et al.
5,496,190 A 3/1996 Ittah et al.

FOREIGN PATENT DOCUMENTS

JP 6-89756 3/1994

*Primary Examiner*—Khiem Nguyen
(74) *Attorney, Agent, or Firm*—Armstrong, Kratz, Quintos, Hanson & Brooks, LLP

(57) ABSTRACT

A locking arm 27 is supported by a fulcrum 31 attached to a body 28 and a pair of coupling portions 33, 34. When an operation portion 30 is pressed down, an engaging portion 29 located between the fulcrum 31 and the coupling portions 33, 34 is shifted vertically to a direction of coupling a connector 10 with a complementary connector 38. The coupling portions 33, 34 are made in parallel to the direction of coupling the connector 10 with the complementary connector 38. The pair of coupling portions 33 and 34 are formed as a pair of legs. A sliding groove 35 is formed between the pair of legs 33 and 34 so as to correspond to an engaging portion 44 of the complementary connector 38. The engaging portion 44 will be slid into the sliding groove 35. In such a configuration, the locking mechanism can remove backlash between a female connector and a male connector to provide high coupling accuracy.

3 Claims, 5 Drawing Sheets

LOCKING MECHANISM FOR CONNECTOR

BACKGROUND OF THE INVENTION

1. Field of the Invention

This invention relates to a locking mechanism for a connector which is used for connection of a wire harness for a vehicle and has a locking arm to be engaged with an engaging portion of a complementary connector.

2. Description of the Related Art

FIGS. 6 and 7 show an example of a technique related to such a kind of locking mechanism, which has been proposed by the applicant of this application and is disclosed in JP-A-6-89756.

As shown in FIG. 6, a male connector 50 which it to incorporate a female terminal 68 has a hood 53 at its front half 51 in the longitudinal direction. An arch-shaped swelling wall 54 is formed outside and integrally to the hood 53. A ring-shaped space 55 corresponding to a complementary female connector 65 is formed inside the hood 53.

Inside the swelling wall 54, a locking arm 56 to be engaged with the engaging portion 67 of the female connector 65 is formed. The locking arm 56 faces the ring-shaped space 55 and is formed in a direction of coupling a pair of connectors 50 and 65.

As seen from FIG. 7, the locking arm 56 includes a body 57 having a fulcrum 57*a* connected to a housing body 62 of the male connector 50, a coupling portion 58 which extends forward in the direction of coupling the male connector 50 from the body 57, and a pressing operating portion 59 which extends reward in the direction of coupling the male connector 50 from the fulcrum 57*a*.

The body 57 is located between the coupling portion 58 and the operation portion 59. The body 57 has a thickness greater than that of the coupling portion 58. The fulcrum 57*a* is located at the rear portion of the body 57, and extends over the entire width of the body 57. The fulcrum 57*a* serves as a rotating furculum when the operation portion 59 is pressed.

The coupling portion 58 is formed from a thin flexible plate, and its tapered tip 58*a* is connected in an inverted ⊐-shape to the front end 54*a* of the swelling wall 54. The width of the connected portion extends over the entire width of the tip 58*a*. A warping space 60 is formed between the upper face 58*b* of the coupling portion 58 and the swelling wall 54.

A locking projection 61 (FIG. 6), which corresponds to a locking portion 67 of the female connector 65, projects downward from the lower face 58*c* of the coupling portion 58. The locking projection 61 is located in the vicinity of the tip of the coupling portion 58. The locking projection has a tapered guiding face 61*a* at its front and a locking face 61*b* at its rear.

The female connector 65 which is to incorporate a plurality of male terminals (not shown) is provided with a hood 66. The pair of connectors 50 and 65 are coupled with each other by fitting the hood 66 in the ring-shaped space 55 of the male connector 50. A locking portion 67 which is to be engaged with the locking projection 61 of the locking arm 56 projects from the outer wall of the hood 66. The pair of connectors 50 and 65 are locked to each other by bringing the locking projection 61 of the locking arm 56 into contact with the vertical locking face 67*a* of the locking portion 67.

As described above, the locking of the above connectors is performed by pushing the female connector 65 into the ring-shaped space 55 of the male connector 50. In this case, the front end 66*a* of the hood 66 intrudes while it is in contact with the locking projection 61 of the locking arm 56 so that the locking portion 67 floats the locking arm 56 in a ^-shape. The female connector 65 advances further deep. When the locking portion 67 completely climbs over the locking projection 61, the locking arm 56 is elastically restored. Thus, the connectors are locked to each other.

The locking is released by pressing the operation portion 59 of the locking arm 56. Specifically, when the operation portion 59 is pressed, the locking arm 56 warps in an arch at the fulcrum 57*a* according to the principle of a lever. The locking between the locking portion 67 and the locking projection 61 is released so that the pair of the connectors can be extracted from each other.

However, the connector described above presents the following problem to be solved.

First, when the locking arm 56 is floated in an arch by pressing the operation portion for coupling the pair of connectors 50 and 65 and its release, the locking projection 61 is not deformed vertically, but deformed on the skew or to draw a circular locus. This may arise a backlash between the connectors 50 and 65.

The occurrence of the backlash makes it impossible to maintain the intimate contact between the connectors 50 and 65. Particularly, in a waterproof connector, a water drop or dust will invade from the gap so that poor connection occurs. The reliability of the electric connection will be impaired.

The locking arm 56 is supported at two points of the furculum 57*a* and the coupling point 58. Therefore, when it suffers external force in the direction (width direction) orthogonal to the longitudinal direction, it is in the bended state due to no wall or member for stopping the external force. Thus, the locking arm 56 may be deformed in the width direction.

SUMMARY OF THE INVENTION

In view of the above circumstance, an object of this this invention is to dissolve the backlash between a female connector and a male connector to provide a connector locking mechanism with high fitting reliability.

In order to attain the above object, in accordance with the invention, there is provided a locking mechanism for a connector having a locking arm in a connector to be engaged with a engaging portion of a complementary connector, wherein said locking arm comprises:

a body having a locking portion and a fulcrum;

an operation portion formed on one end of the body, said operation portion being to be subjected to pressing force; and a coupling portion formed on the other end of the body and integral to a hood of the connector, and said locking arm is supported by said fulcrum and said coupling portion, whereby when said operation portion is pressed, said locking portion which is located between said fulcrum and said coupling portion is shifted vertically to a direction of coupling the connector with the complementary connector.

In this configuration, by shifting the locking portion located between the fulcrum and coupling portion vertically to a direction of coupling the connector with the complementary connector, both connectors can be locked to each other with no clearance between the locking portion and the engaging portion. Therefore, the backlash in the locking arm in the direction of coupling the connector with the complementary connector does not occur so that a connector housing can be miniaturized in the direction of coupling the connector with the complementary connector.

In a preferred embodiment, said coupling portion is formed in parallel to the direction of coupling said connector with the complementary connector.

In this configuration, since said coupling portion is formed in parallel to the direction of coupling said connector with the complementary connector, the locking portion can be shifted vertically to the direction of coupling the connector with the complementary connector. This prevents the backlash in coupling the pair of connectors.

In a preferred embodiment, said coupling portion is formed as a pair of legs.

In the above configuration, the coupling portion is formed as a pair of legs so that the tip of the locking arm is integral to the hood at two points. This greatly improves the posture stability of the locking arm. Thus, the locking portion is shifted vertically to the direction of coupling the connector with the complementary connector, thereby removing the backlash in coupling the pair of connectors.

In a preferred embodiment, the locking mechanism further comprises a sliding groove formed between said pair of legs, said engaging being slid into said sliding groove.

In the above configuration, since a sliding groove is formed between said pair of legs and said engaging is slid into said sliding groove, the engaging portion of the complementary connector is guided into the sliding groove. Thus, a pair of connectors can be coupled with each other with no backlash vertically to the direction of coupling the connector with the complementary connector.

The above and other objects and features of this invention will be more apparent from the following description taken in conjunction with the accompanying drawings.

DESCRIPTION OF THE PREFERRED EMBODIMENTS

Figure 1:
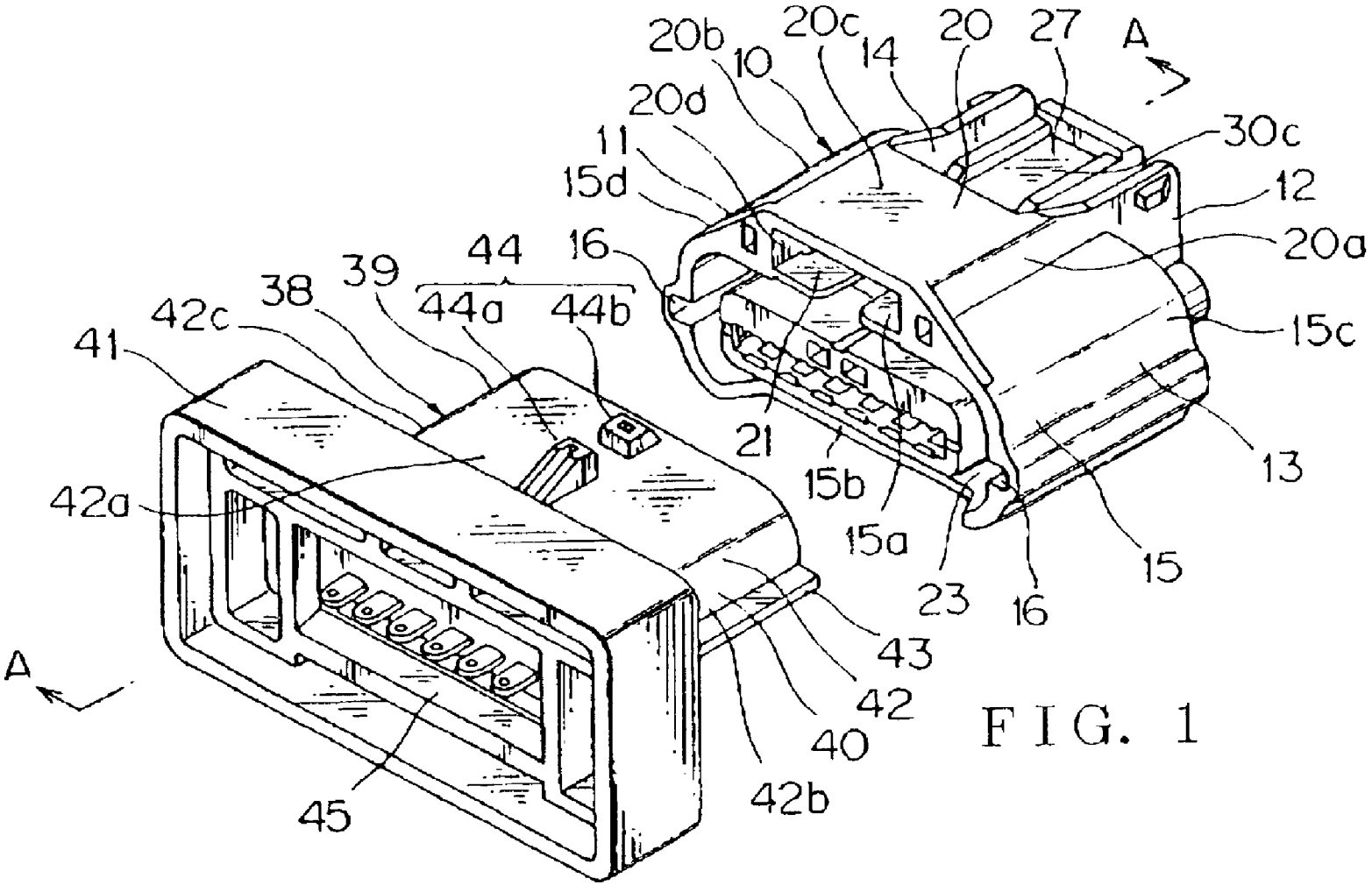
FIG. 1 is a perspective view of a connector locking mechanism according to an embodiment of this invention.

Now referring to the drawings, an explanation will be given of an embodiment of this invention.

FIGS. 1 to 5 show an embodiment of the connector locking mechanism according to this invention.

As seen from FIG. 1, a male connector 10 and a female connector (complementary connector) 38 constitute a pair of connectors. The female connector 38 includes a female connector housing 39 and a male terminal (not shown) equipped with an electric wire (not shown). The male connector 10 includes a male connector housing 11 and a female terminal (not shown) equipped with an electric wire.

The male connector housing 11 includes an external hood 15, a housing main body 12 inside the hood 15, a terminal chamber 24 which accommodates female terminals and a locking arm 27 which faces the ring-shaped space 23.

The hood 15 constitutes an outer wall of the ring-shaped space 23, and is composed of upper and lower walls 15*a* and 15*b* and side walls 15*c* and 15*d* which couple the upper and lower walls.

For convenience for exclamation in the specification, the concepts of "upper/lower", "front/rear" and "left/right" are defined as follows. Although the "upper/lower" can change according to the arrangement of the male connector housing 11 and the female connector housing 39, the side where the locking arm 27 and the engaging portion 44 to be engaged therewith is defined as the upper side. As regards the "front/rear", the side where the connector at issue is fit in the complementary connector (male connector 10 or female connector 38) is defined as the front side. The "left/right" refers to the direction of arranging the male terminals and female terminals.

The upper wall 15*a* of the hood 15 is served by a part of the locking arm 27 described later and formed flat. A square-cylindrical swelling wall 20 is formed outside the upper wall 15*a*. The swelling wall 20 includes side walls 20*a* and 20*b* which are upstanding from the side walls 15*c* and 15*d* on both sides and an upper wall 20*c* which couples these side walls 20*a* and 20*b*. The side walls 20*a* and 20*c* extend rearward and are successive to the housing main body 12. The space formed by the side walls 20*a* and 20*b* and the upper wall 20*c* constitutes a warping space for the locking arm 27. At the rear half of the warping space 21, the upper wall 20*c* is formed to have an opening so that the operation unit 30 is exposed.

The lower wall 15*b* is formed flat to be in parallel to the upper wall 15*a*. The side walls 15*c* and 15*d* are formed in a semi-circular shape. At the centers of the side walls 15*c* and 15*d*, guide grooves 16 are formed so as to correspond to guide ribs 43 formed on the side walls 42*b* and 42*c* of the fitting hood 42. The guide grooves 15 are formed over the entire length of the hood 15 in the longitudinal direction.

The ring-shaped space 23 is formed in a shape which corresponds to the fitting hood 42 of the female connector housing 39. If the ring-shaped space 23 is too large, a water drop or dust may invade. If the space 23 is too small, the pair of connectors 10 and 38 cannot be smoothly coupled with each other. Therefore, taking the sealing between the pair of connectors into consideration, the size of the ring-shaped space 23 is determined.

Figure 2:
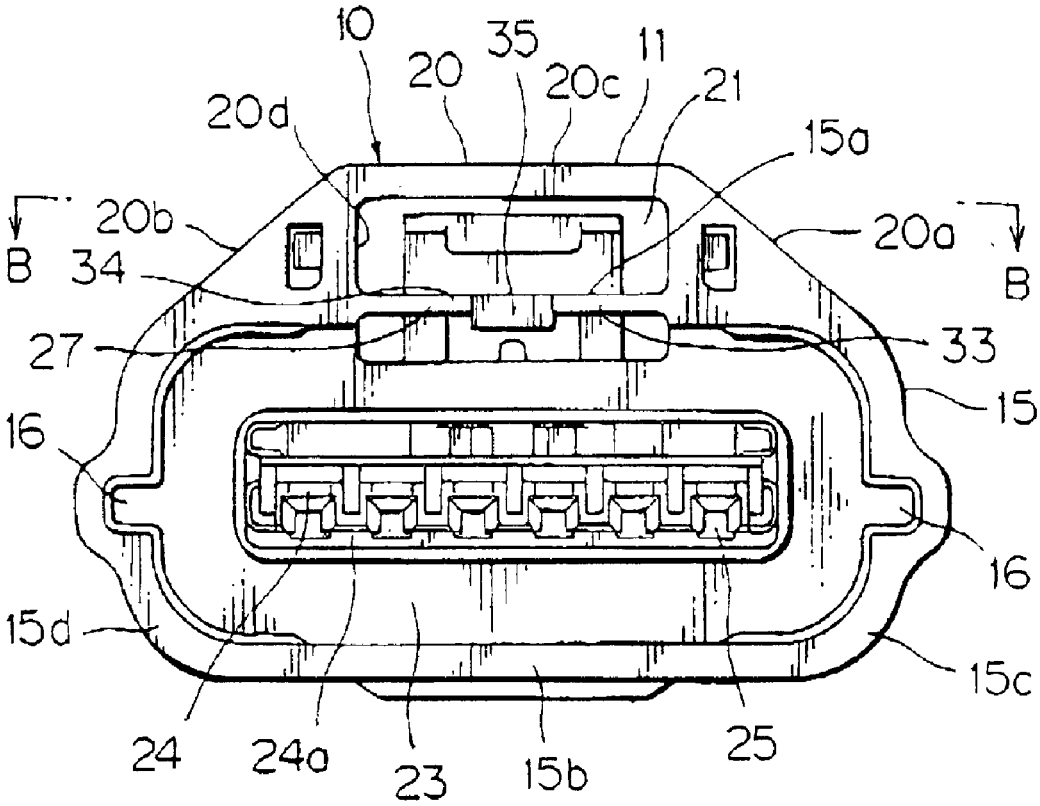
FIG. 2 is a front view of a male connector shown in FIG. 1.

As seen from FIG. 2, the housing body 12 is formed within the hood 15. A grid-like terminal chamber 24 is sectioned in the housing body 12. The terminal chambers 24 are adapted to incorporate six wire-equipped female terminals. Square openings 25 located on the lower side of the terminal chambers 24 serve to insert jigs (not shown) for drawing out the terminals.

In the front end 24*a* and rear end 24*b* of the terminal chamber 24, openings are partially formed, respectively. A male terminal having a tab-like electric contact can be inserted from the opening in the front end 24*a* so that it can be brought into contact with the electric contact of the female terminal. The female terminal can be inserted into the terminal chamber 24 from the opening in the rear end.

In this embodiment, the terminal chambers are arranged in parallel in a single stage in the left/right direction. The respective terminal chamber 24 are sectioned by partitions. Therefore, there is no fear of producing poor connection due to contact between adjacent terminals. The arrangement of the terminal chambers 24 should not be limited to that in this embodiment. They may be arranged in two (upper and lower) stages. The number of terminal chambers 24 to be arranged in the left/right direction may be increased or decreased.

Figure 3:
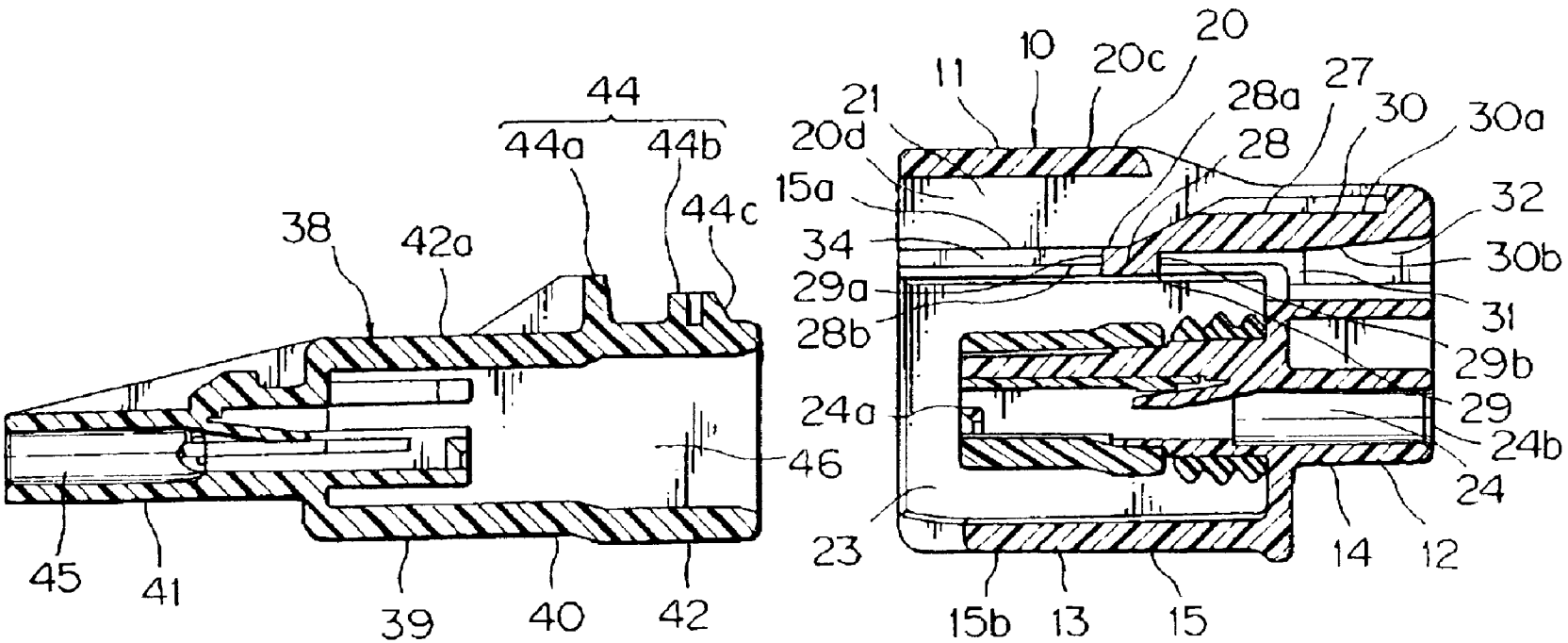
FIG. 3 is a sectional view of a male connector and a female connector taken in line A—A in FIG. 1.

As shown in FIG. 3, the locking arm 27 will be engaged with the engaging portion 44 of the female connector housing 39 so that the pair of connectors 10 and 38 are locked to each other. The locking arm 27 faces the ring-shaped space 23. The locking arm 27 includes a body 28 having a locking projection (locking portion) 29, a pressing operation portion 30 formed on the side of the rear portion of the body 28 and a pair of legs 33 and 34 (coupling portions) formed on the front side of the body 28. The locking arm 27 extends in the direction of coupling the pair of connectors 10 and 38 at the center in the width direction of the male connector housing 11.

Figure 4:
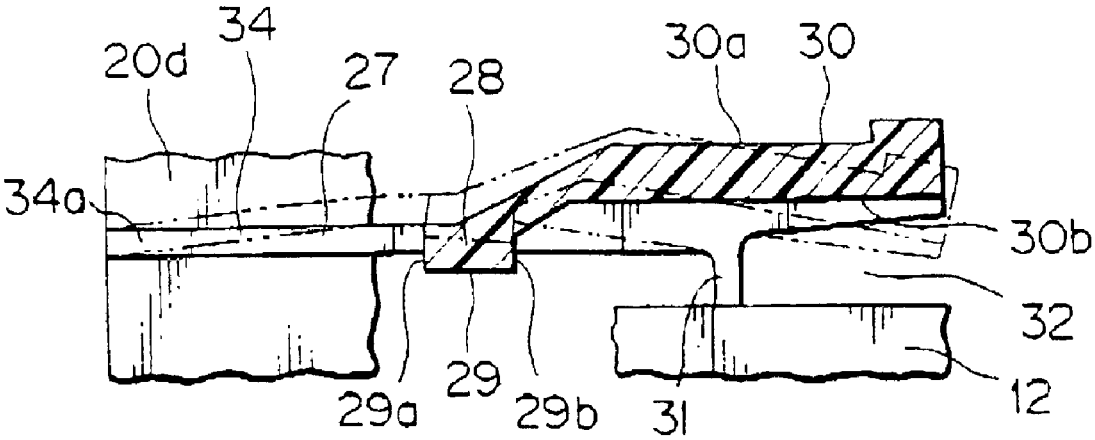
FIG. 4 is a view for explaining the locking arm in FIG. 3.

As seen from FIG. 4, the locking arm 27 is formed as a plate as a whole. The locking arm 27 has a thickness which is gradually increased as it extends from the pair of legs 33, 34 on the front side to the rear end through the body 28. The pair of legs 33, 34 and body 28 are formed in parallel to the direction of coupling the pair of connectors 10 and 38 (FIG. 3). The operation portion successive to the body 28 is higher upward by one stage.

The legs 33 and 34 are formed as a plate having a uniform small thickness, and serve as a part of the wall which constitutes the ring-shaped space 23 (FIG. 1). The tip supporting portions 33*a* and 34*a* of the legs 33 and 34 are integral to the inner wall 20*d* of the swelling wall 20 so that the tips will not warp vertically. The locking arm 28 has the body 28 formed in the vicinity of the base of the pair of legs 33 and 34 so as to be flush therewith.

The locking projection 29 is formed on the lower surface 28*b* of the body so that it corresponds to the engaging portion 44 (FIG. 3) of the female connector housing 39. The locking projection 29 projects downward. The locking projection 29 is located between a fulcrum 31 (described later) and the tip supporting portions 33*a*, 34*a*. When the operation portion 30 is pressed downward, the locking projection 29 changes vertically to the direction of coupling the pair of connectors.

The entire shape of the locking arm 27, position of the locking projection 29, distance between the fulcrum 31 and tip supporting portions 33*a*, 34*a*, sectional area of the locking arm 27, etc can be acquired by computation of numerical values in strength balance and simulation of an analytic model.

The front end 29*a* of the locking protection 29 serves as a crotch of the pair of legs 33 and 34. Therefore, when the engaging portion 44 of the female connector housing 39 advances into the sliding groove 35 between the pair of legs 33 and 34, the engaging portion 44 is brought into contact with the crotch (FIG. 5) so that the advance of the female connector 38 stops once. When the contact force exceeds a certain value, the female connector 38 advances further deep owing to inertia locking. Thus, the engaging portion 44 formed in the hood 42 locks the rear end 29*b* of the locking projection 29 so that the pair of connectors 10 and 38 are completely locked to each other. In this way, the locking of the pair of connectors 10 and 38 is executed separately in two steps so that the locking can be smoothly executed. This reduces the poor connection due to incomplete coupling.

The pressing operation portion 30 is successive to the rear of the body 28 via a slope that rises gradually. On the lower plate 30*b* of the operation portion 30, a pair of furculums 31 are formed downward so as to support the locking arm 27. The fulcrums are integral to the housing body 12. On the upper surface 30*a* of the operation portion 30, a convex portion 30*c* for avoiding slippage when the operation portion 30 is pressed down by a finger is provided (FIG. 5).

The operation portion 30 is located at a higher position by one stage than the pair of legs 33, 34 and body 28 through the slope so that a gap is assured below the operation portion 30. Using this gap 32, the operation portion 30 can be pushed downward. An operator's finger can be placed on the upper face of the operation portion 30 which is exposed.

The locking arm 27 is supported at four points in the front/rear (longitudinal) direction and left/right (width) direction by a pair of fulcrums formed on the lower surface 30*b* of the operation portion 30 and the pair of tip supporting portions 33*a*, 34*a* integral to both sides of the inner wall 20*d* of the swelling wall 20. In this way, the locking arm 27 is supported in the front/rear direction and left/right direction so that its posture stability can be improved.

Figure 5:
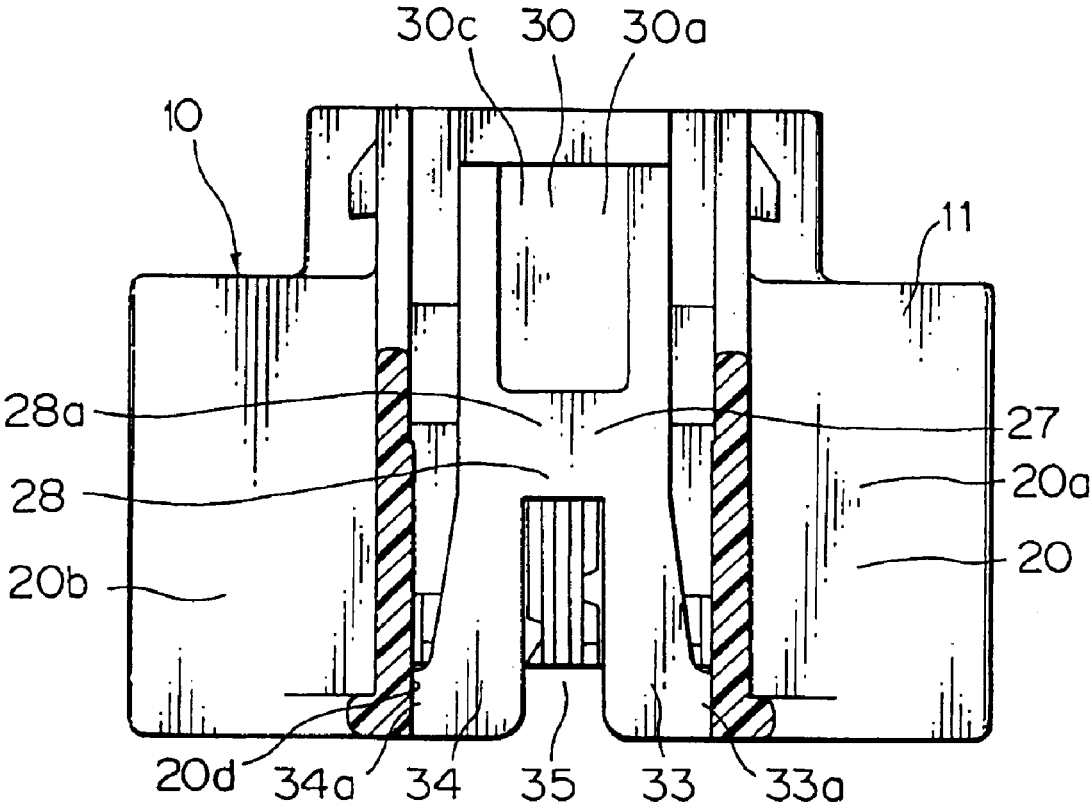
FIG. 5 is a sectional view taken in line B—B in the male connector shown in FIG. 2.
Figure 7:
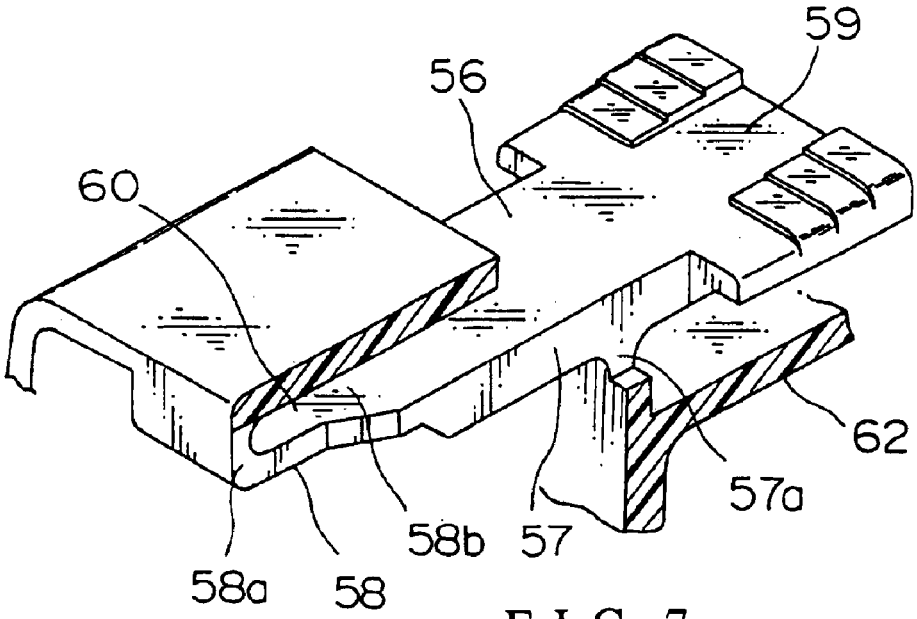
F I G. 7 PRIOR ART
FIG. 7 is a perspective view of the locking arm of the male connector shown in FIG. 6.
Figure 6:
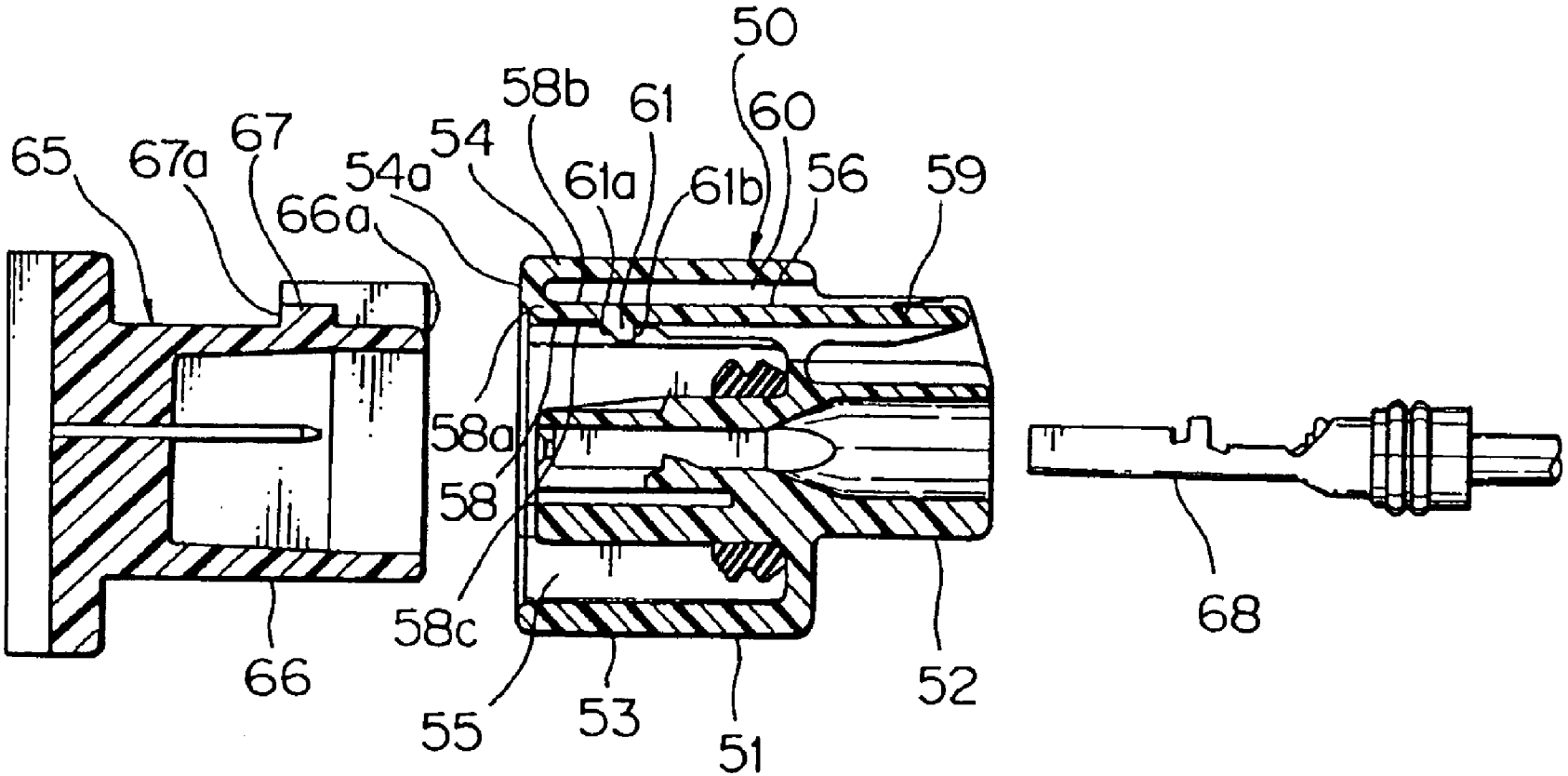
FIG. 6 PRIOR ART
FIG. 6 is a sectional view of a conventional connector locking mechanism.

Particularly, as seen from FIG. 5, the tip supporting portions 33*a* and 34*a* of the locking arm 27 are supported at two points so that the force exerted on the tip supporting portions 33*a* and 34*a* is distributed into two directions by the principle of a lever. Therefore, the posture stability of the locking arm 27 which is to float in an arch shape is improved.

Thus, the locking projection 29 does not shift horizontally but move vertically to the direction of coupling the connectors. This permits the pair of connectors 10 and 38 to be firmly coupled with each other with no backlash. The pair of fulcrums may be replaced by a single furculum 31. In this case, the locking arm 27 will be supported at three points.

Referring to FIG. 3 again, the female connector housing 39 is composed of a front half 40 having a fitting hood 42 corresponding to the male connector housing 11 and a rear half 41 which is rearward successive to the front half 40 in which terminal chambers 45 for accommodating male terminals are formed. Inside the hood 42, a fitting space 46 corresponding to the male connector housing 11 is formed. The tabs of the male terminals project from the deep side of the fitting space 46.

On the upper wall 42*a* of the hood 42, an engaging portion 44 is formed at a position corresponding to the locking projection 29 of the locking arm 27. The engaging portion 44 is a valley formed between the pair of convex portions 44*a* and 44*b*. When the locking projection 29 is engaged with the engaging portion 44, the pair of connectors 10 and 38 is completely locked to each other and positioned in the locking direction.

On the side walls of both sides, the fitting hood 42 is provided with a pair of guide ribs 43 for preventing misalignment when the pair of connectors 10 and 38 are coupled. The guide ribs 43 extend over the entire length in the longitudinal direction on the fitting hood 42. Since these guide ribs 43 advance into the guide grooves 16 of the male connector 10, the pair of connectors 10 and 38 can be smoothly coupled with each other with no backlash.

Where the male connector 10 and female connector 38 are coupled with each other, the female connector 38 is inserted into the ring-shaped space 23 of the male connector 10. In this case, the engaging portion 44 of the female connector 38 advances into the deep side of the male connector 10 while it is guided by the sliding groove 35 (FIG. 2) of the male connector 10. The front end 44*c* of the engaging portion 44 is brought into contact with the base of the pair of legs 33 and 34 so that it stops once. Owing to the inertia locking, the locking projection 29 is vertically deformed by the principle of a lever at the pair of fulcrums 31. The female connector 38 advances further deep so that the locking projection 29 is engaged with the engaging portion 44. Thus, the pair of connectors 10 and 38 are completely locked to each other.

The locking between the male connector and the female connector can be released in such a manner that the operation portion 30 of the locking arm 27 is pressed down to cause the body 28 having the locking projection 29 floats up in an arch shape so that the engagement of the locking projection 29 with the engaging portion 44 is released.

What is claimed is:

1. A locking mechanism for a connector having a locking arm in a connector to be engaged with an engaging portion of a complementary connector, wherein said locking arm comprises:

a body having a locking portion and a fulcrum;

an operation portion formed on one end of the body, said operation portion being to be subjected to pressing force; and a coupling portion formed on the other end of the body, said coupling portion being formed in parallel to the coupling of said connectors and serving as a part of a wall of a hood, wherein said coupling portion comprises tip supporting portions formed on its left side and on its right side in its width direction, respectively, each integral to a respective wall of the hood of the connector, and said locking arm is supported by said fulcrum and said coupling portion, whereby when said operation portion is pressed, said locking portion which is located between said fulcrum and said coupling portion is shifted vertically to a direction of coupling the connector with the complementary connector, wherein the fulcrum is located midway between the locking portion and the operation portion and when the operation portion is depressed the locking portion is raised vertically to release the locking portion from the coupling portion.

2. A locking mechanism for a connector according to claim 1, wherein said coupling portion is formed as a pair of legs.

3. A locking mechanism for a connector according to claim 1, further comprising a sliding groove formed between said pair of legs, said engaging portion being slid into said sliding groove.

* * * * *